US009227765B1

(12) United States Patent
Zhao et al.

(10) Patent No.: US 9,227,765 B1
(45) Date of Patent: Jan. 5, 2016

(54) PACKING BOX OF LIQUID CRYSTAL PANEL

(71) Applicant: Shenzhen China Star Optoelectronics Technology Co., Ltd., Shenzhen, Guangdong (CN)

(72) Inventors: Zhilin Zhao, Guangdong (CN); Shihhsiang Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 14/395,472

(22) PCT Filed: Sep. 4, 2014

(86) PCT No.: PCT/CN2014/085946

§ 371 (c)(1),
(2) Date: Oct. 17, 2014

(30) Foreign Application Priority Data

Sep. 2, 2014 (CN) ..... 2014 1 0443049

(51) Int. Cl.

| | |
|---|---|
| ***B65D 81/02*** | (2006.01) |
| ***B65D 85/48*** | (2006.01) |
| ***B65D 25/10*** | (2006.01) |
| ***B65D 85/30*** | (2006.01) |

(52) U.S. Cl.
CPC ..... *B65D 25/10* (2013.01); *B65D 85/30* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,010,534 | B2 * | 4/2015 | Kuo | B65D 81/053 206/454 |
| 9,038,824 | B2 * | 5/2015 | Zhao | B65D 81/02 206/453 |
| 2008/0128310 | A1 * | 6/2008 | Kao | B65D 81/107 206/521 |
| 2011/0049000 | A1 * | 3/2011 | Ishibashi | B65D 81/053 206/521 |
| 2013/0306514 | A1 * | 11/2013 | Hu | B65D 81/053 206/586 |
| 2014/0097117 | A1 * | 4/2014 | Ogura | B65D 81/055 206/521 |
| 2014/0097121 | A1 * | 4/2014 | Chen | B65D 85/48 206/586 |
| 2014/0102937 | A1 * | 4/2014 | Shi | B65D 81/113 206/521 |

* cited by examiner

*Primary Examiner* — Jacob K Ackun
(74) *Attorney, Agent, or Firm* — Andrew C. Cheng

(57) ABSTRACT

The present invention discloses a packing box of liquid crystal panel. The packing box of liquid crystal panel comprises a box body, on at least two adjacent side walls of the box body respectively being provided with several grooves; the packing box further being provided with an elastic buffer part and a rigid part, the elastic buffer part being provided in the grooves, a first terminal of the elastic buffer part being close to the liquid crystal panel, there being a gap between the inner wall of the groove and a second terminal of the elastic buffer part, the rigid part being mounted on the groove through the position of the gap. In the packing box of liquid crystal panel, the content closely contacts with the packaging material, which avoids the displacement of the content generating secondary impacts during transportation and decreases the damages of the external impacts to the package.

16 Claims, 4 Drawing Sheets

PACKING BOX OF LIQUID CRYSTAL PANEL

BACKGROUND OF THE INVENTION

1. Field of the Invention

The present invention relates to the fields of packing technology, and in particular to a packing box of liquid crystal panel.

2. the Related Arts

In the production of the liquid crystal display device, it comprises an assembly process, which is to assemble the liquid crystal panel, the main control circuit, housing and other parts. Each part is produced and well-sealed up in advance and waits to be assembled to the entire liquid crystal display. Wherein, the liquid crystal panel is sealed in a packing box of liquid crystal panel after being produces, and then is delivered to the appropriate assembly station in box. Currently, there are many packing methods of the liquid crystal panel for industry, the most common type is using a tray made of foaming mold cushioning material to place the liquid crystal panel, or using an injection/blow mold rigid packing box. Relatively, the foaming tray has the advantages of light weight, good cushioning effect, etc., and the liquid crystal panel can contact directly with the outer box; while the rigid strength of the injection/blow mold rigid packing box is better than the foaming box body, but the body basically has no cushioning properties, which needs a soft retaining wall with cushioning effects.

In the traditional packing box mentioned above, the liquid crystal panel is directly put into the box body, the gap between the box body and one side of the panel ranges from 2 to 8 mm. The placement of the gaps is restricted by the precision degree of the packing process. The more precise process tolerance is, the smaller default gap can be, but the gap can not be zero. The assembly of two things must have a matching gap. If there is a gap between the contents and the outer box, the package may produce secondary impact during dropping, which generates multiple destructive impacts to the contents. The larger box manufacturing tolerance is, the gap generated when matching the contents is more uncontrollable, the protective properties of the package to the contents can not be estimated. Therefore, according to the existing packing method of the liquid crystal panel, it has risks of secondary impact damaging the liquid crystal panel. If the gap between the liquid crystal panel and the box body can be zero after packing, it can avoid the secondary impacts as much as possible, which efficiently protects the liquid crystal panel.

SUMMARY OF THE INVENTION

For the above deficiencies of the prior art, the present invention provides a packing box of liquid crystal panel, which avoids the displacement of the content generating secondary impacts during transportation and decreases the damages of the external impacts to the package.

In order to achieve the above object, the present invention provides the following technology: a packing box of liquid crystal panel, comprising: a box body, on at least two adjacent side walls of the box body respectively being provided with several grooves; the packing box further being provided with an elastic buffer part and a rigid part, the elastic buffer part being provided in the grooves, a first terminal of the elastic buffer part being close to the liquid crystal panel, there being a gap between the inner wall of the groove and a second terminal of the elastic buffer part, the rigid part being mounted on the groove through the position of the gap;

wherein, the rigid part squeezes the elastic buffer part so that there is no gap between the elastic buffer part and the liquid crystal panel.

Wherein, the elastic buffer part is a strip structure.

Wherein, the rigid part is a T-shaped structure.

Wherein, after the T-shaped structure of the rigid part is mounted in the gap, the top of the T-shaped structure of the rigid part is higher than the elastic buffer part.

Wherein, the rigid part is made of sheet metal or plastic.

Wherein, the packing box further comprises a buffer sheet, the buffer sheet is provided on the top of the liquid crystal panel.

Wherein, the liquid crystal panel comprises a glass substrate, a circuit board, and multiple flexible printed circuit boards connected with the glass substrate and the circuit board, there are notches within the multiple flexible printed circuit boards; on at least two adjacent side walls of the box body respectively is provided with several grooves, which is provided with an elastic buffer part and a rigid part; the other two side walls of the box body is provided with multiple slots with retainer, the retainer comprises a first arm, a second arm, and a connecting part connected with the first arm and the second arm, the first arm is plugged in the slot, and the second arm is plugged in the notch.

Wherein, the second arm is provided with a cushioning member, the cushioning member is contacted with the liquid crystal panel.

Wherein, the retainer is made of sheet metal or plastic.

Wherein, the packing box further comprises a buffer sheet, the buffer sheet is provided on the top of the liquid crystal panel, on the buffer sheet is provided with a through-hole used to avoid the second arm of the retainer.

Comparing with the prior art, the packing box of liquid crystal panel according to the present invention provides grooves on the side walls of the box body, which is provided with an elastic buffer part and a rigid part. When packing, assemble the elastic buffer part in the grooves firstly. The first terminal thereof is close to the liquid crystal panel, and there is a gap between the inner wall of the groove and the second terminal of the elastic buffer part. Therefore, the rigid part squeezes the elastic buffer part so that there is no gap between the elastic buffer part and the liquid crystal panel, and then the content closely contacts with the packaging material, which avoids the displacement of the content generating secondary impacts during transportation and decreases the damages of the external impacts to the package.

DETAILED DESCRIPTION OF THE PREFERRED EMBODIMENTS

Figure 1:
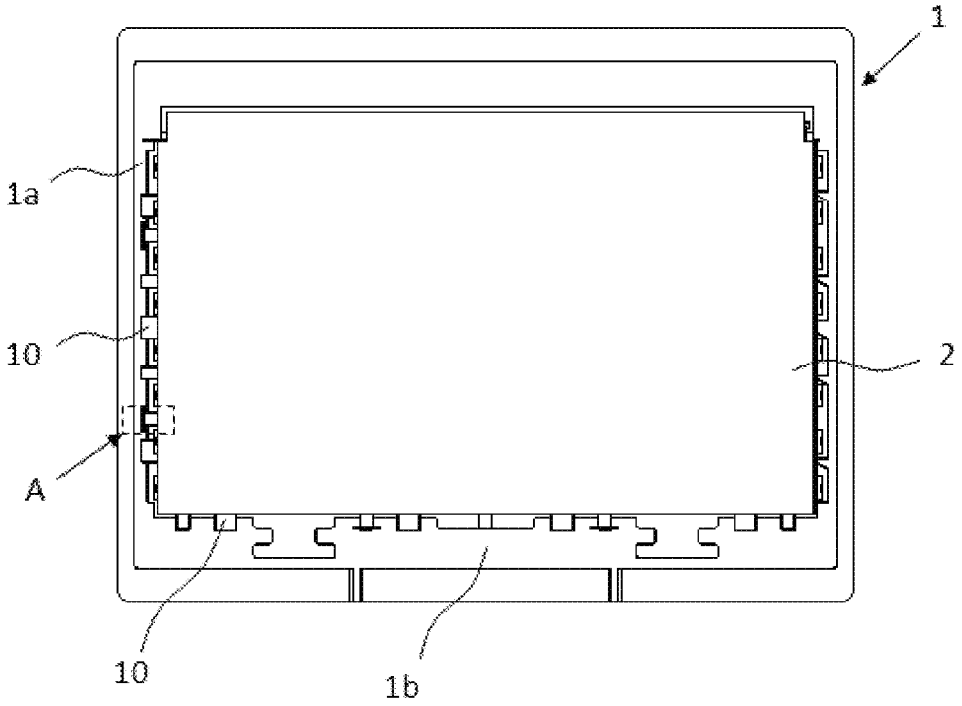
FIG. 1 is a schematic structural diagram of a packing box of liquid crystal panel according to the first embodiment of the present invention.
Figure 2:
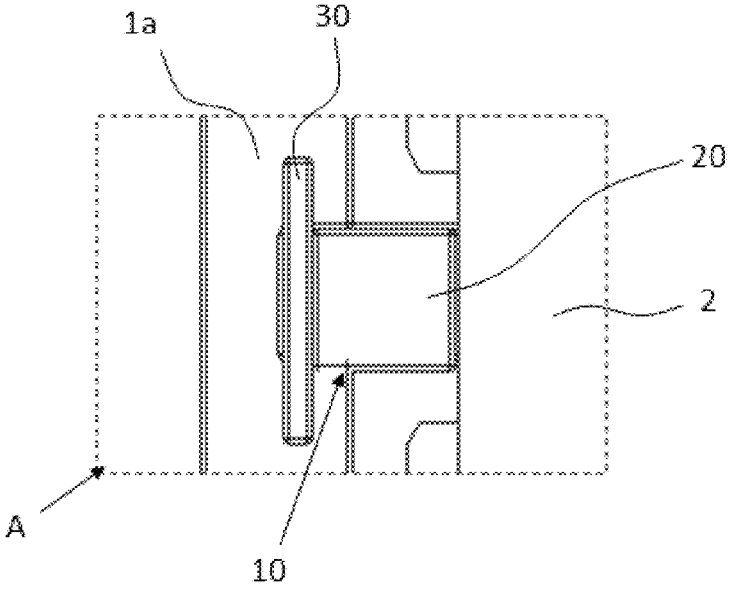
FIG. 2 is an enlarged schematic view of the A portion in FIG. 1.
Figure 3:
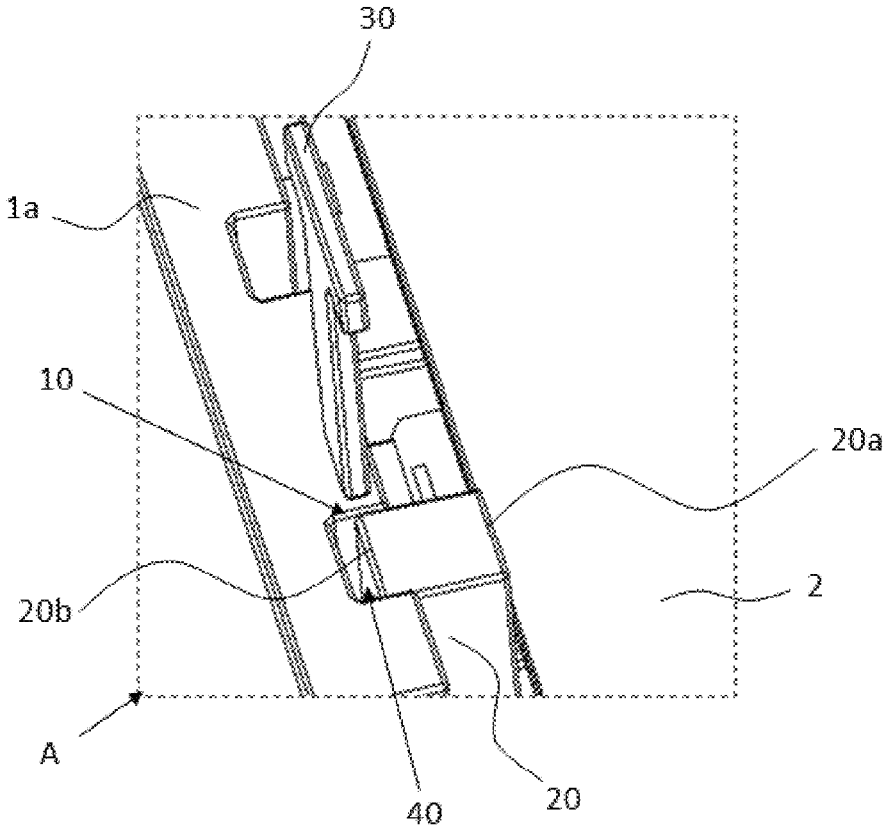
FIG. 3 is an exploded perspective view of the A portion in FIG. 1.
Figure 4:
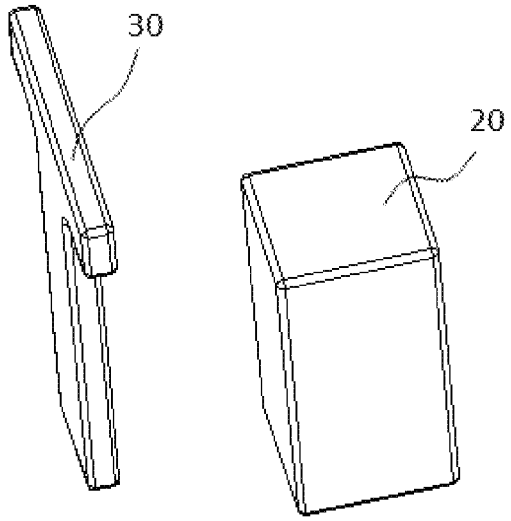
FIG. 4 is a schematic structural diagram of the elastic buffer part and the rigid part according to the first embodiment of the present invention.

As described above, according to the deficiencies of the prior art, the present invention provides a packing box of liquid crystal panel. The packing box of liquid crystal panel comprises a box body, on at least two adjacent side walls of the box body respectively is provided with several grooves. The packing box is further provided with an elastic buffer part and a rigid part. The elastic buffer part is provided in the grooves, a first terminal of the elastic buffer part is close to the liquid crystal panel, and there is a gap between the inner wall of the groove and a second terminal of the elastic buffer part. The rigid part is mounted on the groove through the position of the gap. Therefore, the rigid part squeezes the elastic buffer part so that there is no gap between the elastic buffer part and the liquid crystal panel, and then the content closely contacts with the packaging material, which avoids the displacement of the content generating secondary impacts during transportation and decreases the damages of the external impacts to the package.

The detailed descriptions accompanying drawings and the embodiment of the present invention are as follows.

The First Embodiment

The present embodiment provides a packing box of liquid crystal panel, as shown in FIG. 1-4. The packing box comprises a box body 1. Wherein, on the two adjacent side walls 1*a*, 1*b* of the box body 1 respectively are provided with several grooves 10. The packing box is further provided with an elastic buffer part 20 and a rigid part 30 which match the grooves 10. The elastic buffer part 20 is provided in the grooves 10, a first terminal 20*a* of the elastic buffer part 20 is close to the liquid crystal panel 2, and there is a gap 40 between the inner wall of the groove 10 and a second terminal 20*b* of the elastic buffer part 20. The rigid part 30 is mounted on the groove 10 through the position of the gap 40. Wherein, the rigid part 30 squeezes the elastic buffer part 20 so that there is no gap between the elastic buffer part 20 and the liquid crystal panel 2.

In the present embodiment, the elastic buffer part 20 is a strip structure. The rigid part 30 is a T-shaped structure. Wherein, after the T-shaped structure of the rigid part 30 is mounted in the gap 40, the top of the T-shaped structure of the rigid part 30 is higher than the elastic buffer part 20, which is convenient to unload. Wherein, the rigid part 30 is made of sheet metal or plastic.

Specifically, the process of the packing box according to the present embodiment packing the liquid crystal panel is as follows.

First, put the liquid crystal panel 2 into the packing box, and then move the liquid crystal panel 2 to fit the other two side walls opposite to the side walls 1*a*, 1*b*.

Then, put the elastic buffer part 20 in to the grooves 10 on the side walls 1*a*, 1*b*. The first terminal 20*a* of the elastic buffer part 20 is close to (does not rub) the side wall of the liquid crystal panel 2. In this time, there is a gap 40 between the second terminal 20*b* of the elastic buffer part 20 and the box body 1.

Furthermore, the rigid part 30 is mounted on the groove 10 through the position of the gap 40. The width of the rigid part 30 should larger than that of the gap 40, so the rigid part 30 squeezes the elastic buffer part 20 so that there is no gap between the elastic buffer part 20 and the liquid crystal panel 2. The rigid part 30 can be selected from various specifications with different widths. According to the actual width of the gap 40 in the assembly, select the adapted rigid part 30 to assemble.

Finally, load a buffer sheet on the top of the liquid crystal panel 2, which is also closely assembled in the height direction of the box body 1.

Based on the above description, in the present embodiment, the rigid part 30 squeezes the elastic buffer part 20 so that there is no gap between the elastic buffer part 20 and the liquid crystal panel 2. Namely, there are no gaps within the box body 1, the rigid part 30, the elastic buffer part 20 and the liquid crystal panel 2, so that the content closely contacts with the packaging material, which avoids the displacement of the content generating secondary impacts during transportation and decreases the damages of the external impacts to the package.

The Second Embodiment

Figure 5:
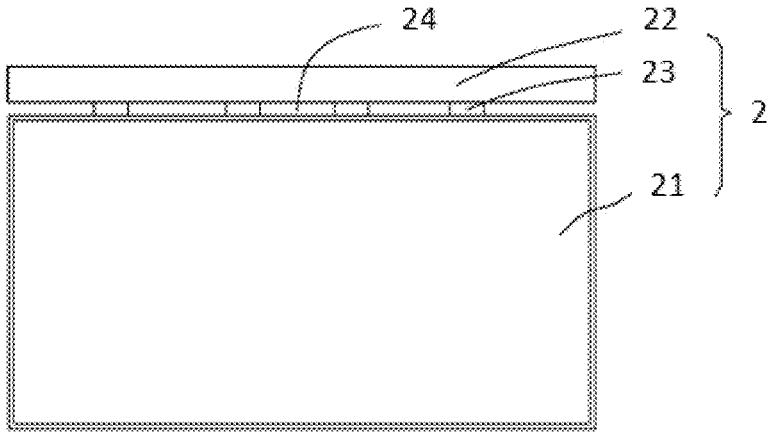
FIG. 5 is a schematic structural diagram of the liquid crystal panel according to the second embodiment of the present invention.

For those liquid crystal panels with super-high-definition, as shown in FIG. 5, the liquid crystal panel 2 comprises a glass substrate 21, a circuit board 22, and multiple flexible printed circuit boards 23 connected with the glass substrate 21 and the circuit board 22. There are notches 24 within the multiple flexible printed circuit boards 23. Because the side of the liquid crystal panel with the flexible printed circuit boards 23 is harder to fix. The flexible printed circuit boards 23 are easy to be damaged if there are impacts during transportation.

Figure 6:
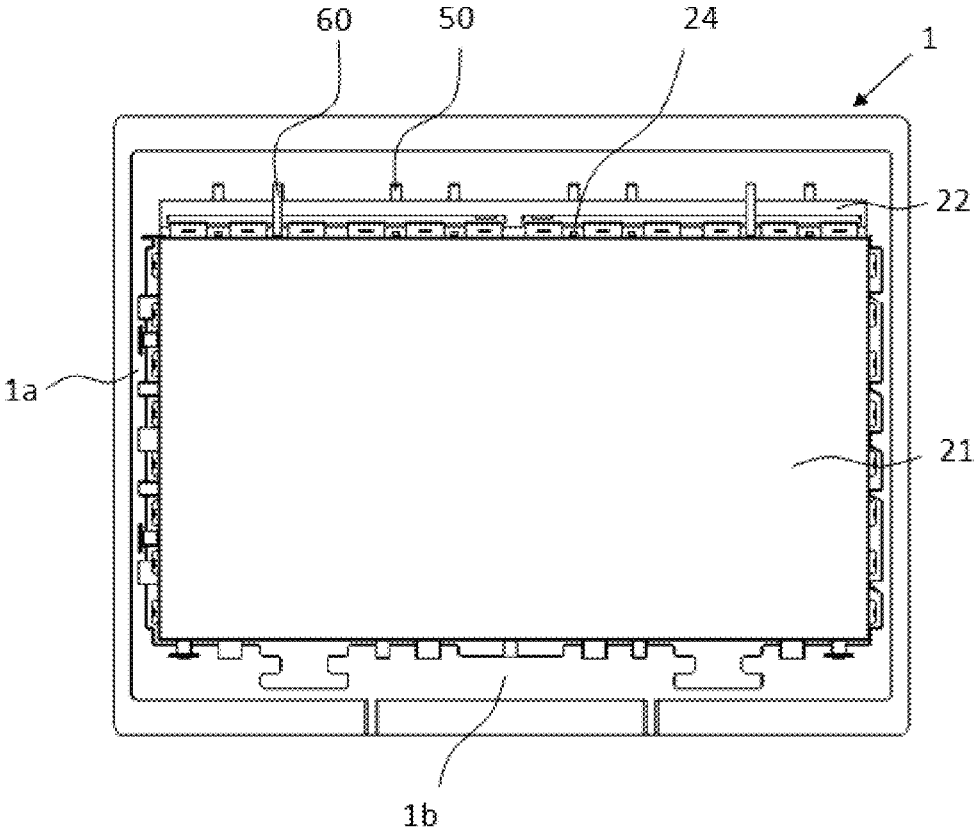
FIG. 6 is a schematic structural diagram of the packing box of liquid crystal panel according to the second embodiment of the present invention.
Figure 7:
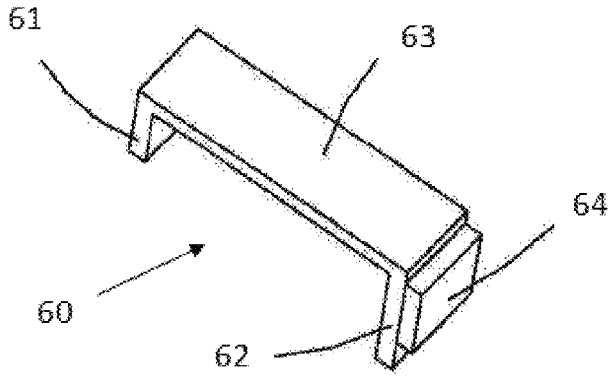
FIG. 7 is a schematic structural diagram of the retainer according to the second embodiment of the present invention.

In view of this, in the present embodiment, as shown in FIG. 6, based on the first embodiment, the other side wall opposite to the side wall 1*b* of the box body 1 is provided with multiple slots 50 with retainer 60. In the another embodiments, it can also provide multiple slots 50 with retainer 60 on the other two side walls opposite to the side walls 1*a*, 1*b* of the box body 1, which is mainly chosen according the glass substrate 21, the circuit board 22, and the flexible printed circuit boards 23 of the liquid crystal panel 2. Wherein, as shown in FIG. 7, the retainer 60 comprises a first arm 61, a second arm 62, and a connecting part 63 connected with the first arm 61 and the second arm 62. When assembling, the first arm 61 of the retainer 60 is plugged in the slot 50, and the second arm 62 is plugged in the notch 24. The retainer 60 fixes the liquid crystal panel 2 across the circuit board 22, which not only fixes the liquid crystal panel 2, but also protects the circuit board 22 and the flexible printed circuit boards 23 from the impact. Moreover, in the present embodiment, referring to FIG. 7, the second arm 62 is provided with a cushioning member 64, and the cushioning member 64 is contacted with the glass substrate 21 of the liquid crystal panel 2.

Wherein, the retainer 60 is made of sheet metal or plastic.

Specifically, the process of the packing box according to the present embodiment packing the liquid crystal panel is as follows.

First, put the liquid crystal panel 2 into the packing box, and then move the liquid crystal panel 2 to fit the other two side walls opposite to the side walls 1*a*, 1*b*. At this time, on the side wall opposite to the side wall 1*b*, the first arm 61 of the retainer 60 is plugged in the slot 50, and the second arm 62 is plugged in the notch 24 of the liquid crystal panel 2.

Then, put the elastic buffer part 20 in to the grooves 10 on the side walls 1*a*, 1*b*. The first terminal 20*a* of the elastic buffer part 20 is close to (does not rub) the side wall of the liquid crystal panel 2. In this time, there is a gap 40 between the second terminal 20*b* of the elastic buffer part 20 and the box body 1.

Furthermore, the rigid part 30 is mounted on the groove 10 through the position of the gap 40. The width of the rigid part 30 should larger than that of the gap 40, so the rigid part 30 squeezes the elastic buffer part 20 so that there is no gap between the elastic buffer part 20 and the liquid crystal panel 2. The rigid part 30 can be selected from various specifications with different widths. According to the actual width of the gap 40 in the assembly, select the adapted rigid part 30 to assemble.

Figure 8:
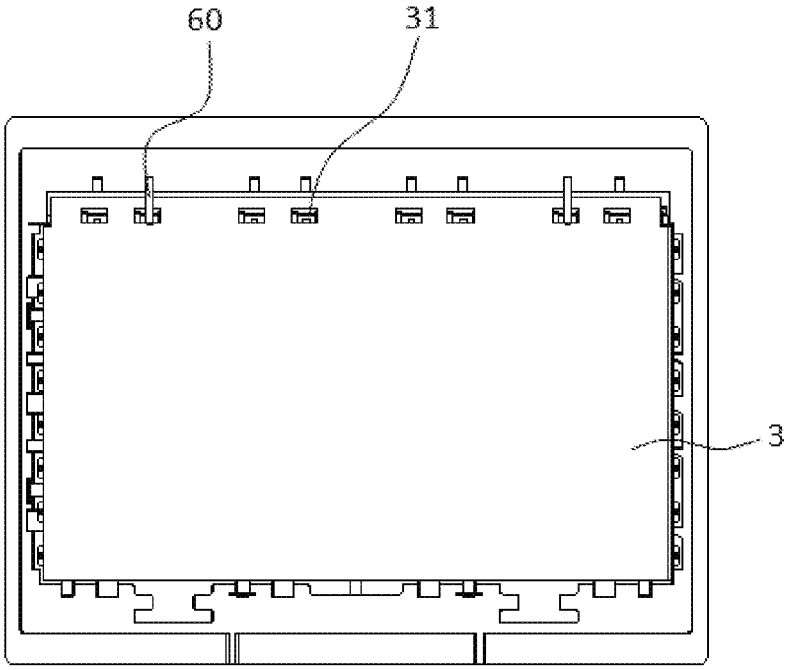
FIG. 8 is a schematic structural diagram of the packing box with buffer sheet according to the second embodiment of the present invention.

Finally, load a buffer sheet 3 on the top of the liquid crystal panel 2, which is also closely assembled in the height direction of the box body 1. In the present embodiment, as shown in FIG. 8, on the buffer sheet 3 is provided with a through-hole 31 used to avoid the second arm 62 of the retainer 60. When assembling, the second arm 62 of the retainer 60 is plugged in the notch 24 of the liquid crystal panel 2 through the through-hole 31.

It needs to notice that, in this article, the relational terms such as first and second is only used to distinguish one entity or operating another entity or an operation, it is not necessary to require or imply that there exists any such relationship or sequence between the entity and operation. Besides, the terms "comprise," "include," or any other variation are intended to cover a non-exclusive inclusion, thereby making that comprising a series of process, method, materials or apparatus of element not only comprise those elements, but also comprise other elements not expressly listed, or also comprise such inherent elements of process, method, materials or apparatus. In the absence of more restrictive conditions, limiting the elements by the statement "comprises a . . . ", it doesn't exclude that it also exists other identical elements in comprising the process, method, materials or apparatus of element.

The preferred embodiments of the present invention have been described above. It should be noted that, for those having ordinary skills in the art, any deduction or modification according to the present invention is considered encompassed in the scope of protection defined by the claims of the present invention.

What is claimed is:

1. A packing box of liquid crystal panel, comprising: a box body, on at least two adjacent side walls of the box body respectively being provided with several grooves; the packing box further being provided with an elastic buffer part and a rigid part, the elastic buffer part being provided in the grooves, a first terminal of the elastic buffer part being close to the liquid crystal panel, there being a gap between the inner wall of the groove and a second terminal of the elastic buffer part, the rigid part being mounted on the groove through the position of the gap; wherein, the rigid part squeezes the elastic buffer part so that there is no gap between the elastic buffer part and the liquid crystal panel.

2. The packing box of liquid crystal panel as claimed in claim 1, wherein the elastic buffer part is a strip structure.

3. The packing box of liquid crystal panel as claimed in claim 1, wherein the rigid part is a T-shaped structure.

4. The packing box of liquid crystal panel as claimed in claim 3, wherein after the T-shaped structure of the rigid part is mounted in the gap, the top of the T-shaped structure of the rigid part is higher than the elastic buffer part.

5. The packing box of liquid crystal panel as claimed in claim 4, wherein the rigid part is made of sheet metal or plastic.

6. The packing box of liquid crystal panel as claimed in claim 1, wherein the rigid part is made of sheet metal or plastic.

7. The packing box of liquid crystal panel as claimed in claim 1, wherein the packing box further comprises a buffer sheet, the buffer sheet is provided on the top of the liquid crystal panel.

8. A packing box of liquid crystal panel, wherein the liquid crystal panel comprises a glass substrate, a circuit board, and multiple flexible printed circuit boards connected with the glass substrate and the circuit board, there are notches within the multiple flexible printed circuit boards; the packing box comprising a box body, on at least two adjacent side walls of the box body respectively being provided with several grooves; the packing box further being provided with an elastic buffer part and a rigid part, the elastic buffer part being provided in the grooves, a first terminal of the elastic buffer part being close to the liquid crystal panel, there being a gap between the inner wall of the groove and a second terminal of the elastic buffer part, the rigid part being mounted on the groove through the position of the gap; wherein, the rigid part squeezes the elastic buffer part so that there is no gap between the elastic buffer part and the liquid crystal panel; the other two side walls of the box body being provided with multiple slots with retainer, the retainer comprising a first arm, a second arm, and a connecting part connected with the first arm and the second arm, the first arm being plugged in the slot, and the second arm being plugged in the notch.

9. The packing box of liquid crystal panel as claimed in claim 8, wherein the elastic buffer part is a strip structure.

10. The packing box of liquid crystal panel as claimed in claim 8, wherein the rigid part is a T-shaped structure.

11. The packing box of liquid crystal panel as claimed in claim 10, wherein after the T-shaped structure of the rigid part is mounted in the gap, the top of the T-shaped structure of the rigid part is higher than the elastic buffer part.

12. The packing box of liquid crystal panel as claimed in claim 11, wherein the rigid part is made of sheet metal or plastic.

13. The packing box of liquid crystal panel as claimed in claim 8, wherein the rigid part is made of sheet metal or plastic.

14. The packing box of liquid crystal panel as claimed in claim 8, wherein the second arm is provided with a cushioning member, the cushioning member is contacted with the liquid crystal panel.

15. The packing box of liquid crystal panel as claimed in claim 8, wherein the retainer is made of sheet metal or plastic.

16. The packing box of liquid crystal panel as claimed in claim 8, wherein the packing box further comprises a buffer sheet, the buffer sheet is provided on the top of the liquid crystal panel, on the buffer sheet is provided with a through-hole used to avoid the second arm of the retainer.

* * * * *